US005506390A

United States Patent [19]

Seo

[11] Patent Number: 5,506,390

[45] Date of Patent: Apr. 9, 1996

[54] THAWING CONTROL APPARATUS AND METHOD FOR A MICROWAVE OVEN

[75] Inventor: Young J. Seo, Pusan, Rep. of Korea

[73] Assignee: Goldstar Co., Ltd., Seoul, Rep. of Korea

[21] Appl. No.: 366,623

[22] Filed: Dec. 30, 1994

[30] Foreign Application Priority Data

Dec. 30, 1993 [KR] Rep. of Korea ..... 1993/31207

[51] Int. Cl.[6] ..... H05B 6/68

[52] U.S. Cl. ..... 219/703; 219/705; 219/708; 219/716; 426/241; 99/325

[58] Field of Search ..... 219/703, 704, 219/708, 715, 716, 518, 705; 99/325, DIG. 14; 426/241, 243

[56] References Cited

U.S. PATENT DOCUMENTS

| | | | |
|---|---|---|---|
| 4,317,977 | 3/1982 | Buck | 219/705 |
| 4,413,168 | 11/1983 | Teich | 219/708 |
| 4,520,251 | 5/1985 | Yokozeki | 219/10.55 M |
| 4,533,809 | 8/1985 | Eke | 219/710 |
| 4,595,827 | 6/1986 | Hirai | 219/708 |
| 4,599,503 | 7/1986 | Ueda | 219/10.55 M |
| 4,672,181 | 6/1987 | Sakamoto | 219/708 |
| 4,703,151 | 10/1987 | Sakamoto | 219/708 |
| 4,705,926 | 11/1987 | Sakai | 219/703 |
| 4,814,570 | 3/1989 | Takizaki | 219/708 |
| 4,939,330 | 7/1990 | Berggren et al. | 219/10.55 M |
| 5,208,432 | 5/1993 | Han | 219/716 |
| 5,212,360 | 5/1993 | Carlson | 219/716 |
| 5,293,019 | 3/1994 | Lee | 219/708 |

*Primary Examiner*—Philip H. Leung
*Attorney, Agent, or Firm*—Christie, Parker & Hale

[57] ABSTRACT

A control apparatus and method for a microwave oven capable of fixing an optimum thawing time, coping with unexpected voltage variation of an input AC source. According to the aforesaid apparatus and method, a weight factor corresponding to an input source voltage variation is found, a thawing time proportional to weight of a food item to be thawed is determined, and as a result a final optimum thawing time is determined by multiplying the weight factor and the thawing time together.

4 Claims, 2 Drawing Sheets

| INPUT AC VOLTAGE | WEIGHT FACTOR (α) |
|---|---|
| 120V OR MORE | 0.7 |
| 119 ~ 118V | 0.75 |
| 117 ~ 116V | 0.80 |
| 115 ~ 114V | 0.90 |
| 113 ~ 112V | 0.95 |
| 111 ~ 110V | 1.00 |
| 109 ~ 108V | 1.05 |
| 107 ~ 106V | 1.05 |
| 105 ~ 104V | 1.10 |
| 103 ~ 102V | 1.10 |
| 101 ~ 100V | 1.20 |
| 99 ~ 98V | 1.25 |
| 97 ~ 96V | 1.25 |
| 95 ~ 94V | 1.25 |
| 93 ~ 92V | 1.3 |
| 92 ~ 91V | 1.3 |
| 90V OR LESS | 1.4 |

THAWING CONTROL APPARATUS AND METHOD FOR A MICROWAVE OVEN

BACKGROUND OF THE INVENTION

1. Field of the Invention

The present invention relates to a microwave oven (hereinafter referred to as "MWO"), and more particularly to a thawing control apparatus and method for an MWO which is capable of fixing an optimum thawing time, coping with unexpected voltage variation of an input AC source.

2. Description of the Prior Art

A conventional thawing control apparatus for an MWO is, with reference to FIG. 1, composed of a rectification section 1 for rectifying the AC source lowered by a power transformer PT, and for smoothing the rectified source voltage so as to make a complete DC, a voltage regulation section 2 for regulating the voltage of the output DC from the rectification section 1, a weight detection section 3 for detecting the weight of a food item to be thawed as an electrical value, a processor 4 for fixing an appropriate thawing time corresponding to the weight value measured at the weight detection section 3, and a relay drive section 5 for driving a relay which controls the operation of an MWO. In the drawings, RY stands for a relay and 2A for a voltage regulator.

In operation, the AC source, the voltage of which is lowered by the power transformer PT, is full-wave-rectified by diodes D1 and D2, and is smoothed by capacitors C1 and C2 in the rectification section 1. Thereafter, the rectified source voltage from the rectification section 1 is regulated and supplied as a DC supply voltage to the processor 4.

Meanwhile, the weight value of a food item measured at the weight detection section 3 is provided as an electrical signal to the processor 4 through its input port A1, the processor 4 determines a thawing time proportional to the weight value.

After determining the thawing time, the processor 4 provides a drive signal corresponding to the thawing time to the relay drive section 5 through its output port P. A transistor Q1 in the relay drive section 5 switches a relay RY for control of the operation of an MWO. Hence, a proper thawing matching weight of a food item could be achieved.

However, because the conventional MWO is incapable of coping with unexpected voltage variation of an input AC source, a food item to be thawed may be unsuitably over- or under-thawed.

SUMMARY OF THE INVENTION

The present invention has been developed to avoid the above-stated problem. A thawing control apparatus and method for an MWO according to the present invention detects voltage variation of an input AC source, and finds a weight factor, having been prepared as data in the processor, corresponding to the detected voltage variation. Then, the final optimum thawing time is calculated by multiplying the weight factor and the ready-determined thawing time together.

In one aspect of the present invention, there is provided a thawing control apparatus for a microwave oven, comprising:

means for weighing a food item to be thawed;

means for detecting a voltage level of an input AC source; and control means for determining a thawing time by the weight measured at said weight measuring means, and for finding a weight factor corresponding to the voltage level detected at said voltage detection means, and for thereby determining a final optimum thawing time by utilizing both said thawing time and said weight factor.

In another aspect of the present invention, there is provided a thawing control method for a microwave oven, comprising the steps of:

weighing a food item to be thawed, and determining a thawing time corresponding to the detected weight;

detecting a voltage level of an input AC source, and finding a weight factor corresponding to the detected voltage level; and determining a final optimum thawing time by utilizing both said thawing time and said weight factor.

BRIEF DESCRIPTION OF THE DRAWINGS

This and other objects and features of the present invention will become apparent from the following description taken in conjunction with a preferred embodiment thereof with reference to the accompanying drawings, in which.

DETAILED DESCRIPTION OF THE PREFERRED EMBODIMENT

Figure 1:
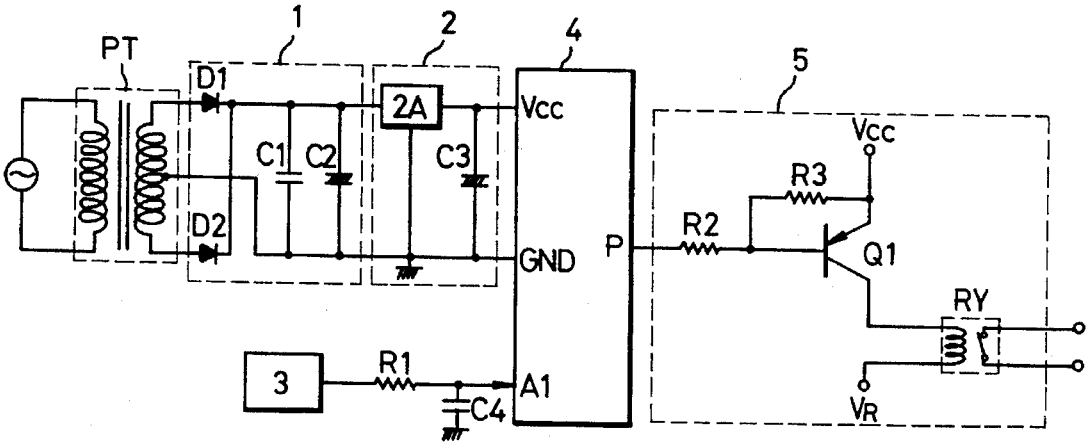
FIG. 1 (PRIOR ART)
FIG. 1 is a circuit diagram of a conventional thawing control apparatus for an MWO.
Figure 2:
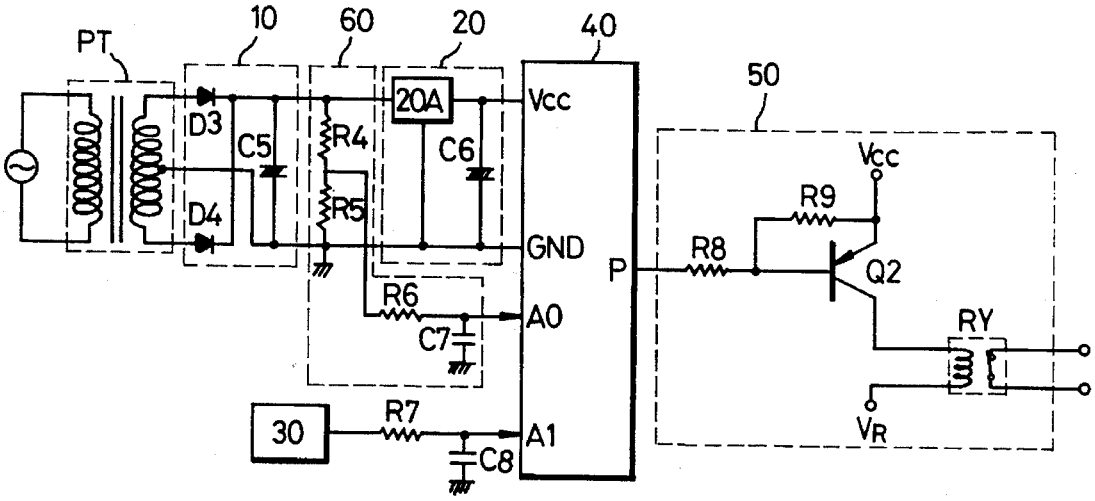
FIG. 2 is a circuit diagram of a thawing control apparatus according to the present invention.

FIG. 2 is a circuit diagram of a thawing control apparatus in accordance with the present invention.

In construction, the present invention is composed of a rectification section 10 employing a power transformer PT, for rectifying an AC source voltage lowered at the power transformer PT, and for smoothing the rectified source voltage so as to make a complete DC; a voltage regulation section 20 employing a voltage regulator 20A and a capacitor C3, the voltage regulator 20A regulates the output DC from the rectification section 10; a weight detection section 30 for measuring weight of a food item to be thawed as a reference for a thawing time; a voltage detection section 60 for detecting the amount of voltage variation of the output voltage from the rectification section 10, this voltage from the rectification section 10 varies according to voltage variation of an input AC source; a processor 40 working at the supply voltage from the voltage regulation section 20, for determining an appropriate thawing time in accordance with the weight value measured at the weight detection section 30, and for compensating the thawing time using a weight factor ($\alpha$) corresponding to the voltage variation detected by the voltage detection section 60, and a relay drive section 50 for driving a relay which controls the operation of an MWO.

In detail, the voltage detection section 60 employs resistors R4 and R5 playing a role of a voltage divider on the output voltage from the rectification section 10, and a resistor R6 and a capacitor C7 both constituting a noise rejection filter for rejecting noise appearing over the voltage divided by the resistors R4 and R5, so as to achieve accurate voltage detection.

Figures 3, 4:
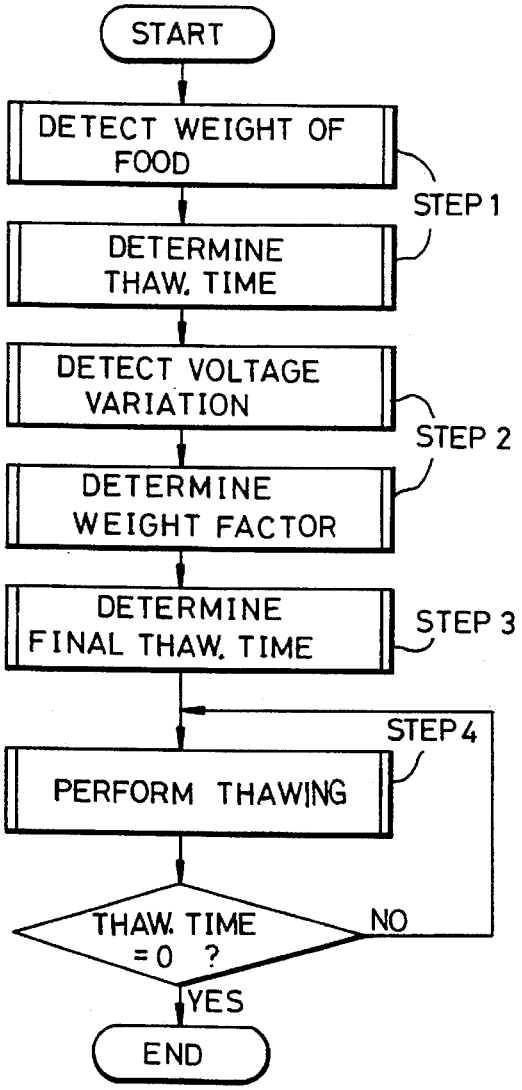
FIG. 3 is a flowchart showing the algorithm of a thawing control method according to the present invention.
FIG. 4 is a table showing the exemplified configuration of weight factors in accordance with voltage variation of an input AC source.

FIG. 3 is a flowchart showing the algorithm of a thawing control method according to the present invention. On a step-by-step basis, as to step 1, an appropriate thawing time $T_W$ is determined according to the weight value of a food item to be thawed measured at the weight detection section 30. According to step 2, a weight factor (α) for compensation for the thawing time $T_W$ is found, which is correspondent to the voltage variation of the input AC source detected at the voltage detection section 60, and this weight factor has been stored earlier, as data per voltage variation, at a memory in the processor 40. In step 3, a final optimum thawing time $T_{WA}$ is determined by multiplying the thawing time $T_W$ and the weight factor (α) together. In accordance with step 4, a thawing operation is accomplished by controlling the relay drive section 50 according to the final optimum thawing time $T_{WA}$.

In operation, with reference to FIGS. 2 and 3, an AC source voltage is lowered by the power transformer PT, the lowered AC source voltage is thereafter rectified by diodes D3 and D4, and smoothed by a capacitor C5 in the rectification section 10.

The rectified DC voltage is regulated by the voltage regulator 20A in the voltage regulation section 20, and is supplied as a supply voltage to the processor 40.

At this time the weight value of the food item is provided from the weight detection section 30 to the input port A1 of the processor 40, and the processor 40 determines a thawing time $T_W$ corresponding to that weight value.

Meanwhile, the output DC voltage of the rectification section 10 is divided by the voltage divider R4 and R5 located in the voltage detection section 60, and the divided voltage is thereafter provided to the input port A0 of the processor 40. The processor 40 analyzes the original voltage value of the input AC source using a voltage detected by the voltage detection section 60, and finds a corresponding weight factor (α).

That is to say, the processor 40 retrieves the weight factors (α), as shown in FIG. 4, stored at the memory thereof in accordance with every voltage variation of an input AC source. The resistor R6 and the capacitor C7 in the voltage detection section 60 play a part of a noise rejection filter for eliminating noise over the voltage divided by the resistors R4 and R5.

The processor 40 determines a final optimum thawing time $T_{WA}$ by multiplying the weight factor (α) and the thawing time together.

A set of thawing sequence is finished by controlling the relay drive section 50 to the extent that the operation of an performs a thawing operation according to the final optimum thawing time $T_{WA}$. The relay RY in the relay drive section 50 controls switchably the operation of an MWO according to the duration of the final optimum thawing time $T_{WA}$.

From the foregoing, in the present invention, a thawing time can be compensated by a weight factor corresponding to the voltage variation of an input AC source. As an advantage of the present invention, irregularities in thawing time caused by the voltage variation of an input AC source is prevented.

What is claimed is:

1. A thawing control apparatus for a microwave oven which will vary the final optimum thawing time of the content of the microwave oven as a function of an input AC source, comprising:

means for measuring a weight of food to be thawed in the microwave oven;

means for sensing the voltage level of the input AC source; and control means coupled to the measuring means and the sensing means for determining a thawing time corresponding to the measured weight and a weight factor corresponding to the sensed voltage and for controlling the final optimum thawing time as a function of both the thawing time and the weight factor.

2. A thawing control apparatus for a microwave oven according to claim 1, wherein said control means controls said final optimum thawing time by multiplying said thawing time and said weight factor together.

3. A thawing control method for a microwave oven which will vary the final optimum thawing time of the content of the microwave oven as a function of an input AC source, comprising the steps of:

weighing a food item to be thawed in said microwave oven and determining a thawing time corresponding to the weight;

sensing the voltage level of the input AC source, and finding a weight factor corresponding to said sensed voltage level; and determining the final optimum thawing time by utilizing both said thawing time and said weight factor.

4. A thawing control method for a microwave oven according to claim 3, wherein the step of determining said final optimum thawing time is determined by multiplying said thawing time and said weight factor together.

* * * * *

UNITED STATES PATENT AND TRADEMARK OFFICE

CERTIFICATE OF CORRECTION

PATENT NO. : 5,506,390

DATED : April 9, 1996

INVENTOR(S) : Young J. Seo

It is certified that error appears in the above-indentified patent and that said Letters Patent is hereby corrected as shown below:

Column 4, line 2, after "operation of an"
insert -- MWO --.

Signed and Sealed this

Fifth Day of November, 1996

*Attest:*

*Attesting Officer*

BRUCE LEHMAN

*Commissioner of Patents and Trademarks*